United States Patent [19]

Schilling et al.

[11] Patent Number: 5,018,460

[45] Date of Patent: May 28, 1991

[54] EMBROIDERING MACHINE WITH A MOUNTING DEVICE FOR INDIVIDUAL EMBROIDERY HOOPS

[75] Inventors: Lothar Schilling, Kaiserslautern; Gottfried Schmidt, Stebach, both of Fed. Rep. of Germany

[73] Assignee: Pfaff Industriemaschinen GmbH, Kaiserslautern, Fed. Rep. of Germany

[21] Appl. No.: 488,288

[22] Filed: Mar. 2, 1990

[30] Foreign Application Priority Data

Mar. 3, 1989 [DE] Fed. Rep. of Germany ..... 3919861

[51] Int. Cl.[5] ..... D05C 9/04

[52] U.S. Cl. ..... 112/103; 38/102.2

[58] Field of Search ..... 112/103, 102, 121.12, 112/121.15, 98, 86, 90; 38/102.2

[56] References Cited

U.S. PATENT DOCUMENTS 4,411,208 10/1983 Nishida et al. ..... 112/103

4,834,006 5/1989 Goto ..... 112/103

FOREIGN PATENT DOCUMENTS 1260052 10/1989 Japan ..... 112/103

*Primary Examiner*—Peter Nerbun

*Attorney, Agent, or Firm*—McGlew & Tuttle

[57] ABSTRACT

An embroidering machine with a mounting device for individual embroidery hoops is provided with a design in which each individual embroidery hoop is always mounted with the same holding force and is always brought into the correct position for the start of the embroidery process. To ensure the three-point mounting of the individual embroidery hoop, which consists of an inner hoop and an outer hoop surrounding it, with the fabric to be embroidered located between them, the mounting device comprises two opposite holders, one of which has two contact surfaces enclosing an angle for fitted support surfaces of the outer hoop, and the other holder having a bow spring with a depression for a projection arranged on the outer hoop on the bisector of the angle enclosed between the contact surfaces. If the outer hoop is transversely slotted and its ends are connected by a turnbuckle, symmetrical expansion of the outer hoop independently of the thickness of the fabric to be embroidered will be achieved due to the fact that the turnbuckle is arranged in the axis of symmetry of the contact surface at the bow spring of one holder and the contact surface or contact surfaces of the opposite holder.

23 Claims, 3 Drawing Sheets

EMBROIDERING MACHINE WITH A MOUNTING DEVICE FOR INDIVIDUAL EMBROIDERY HOOPS

FIELD AND BACKGROUND OF THE INVENTION

The present invention pertains to an embroidering machine with a mounting device for individual embroidery hoops, which are to be detachably connected to the mounting device. The hoops consist of a inner hoop with an outer hoop surrounding the inner hoop with the fabric to be embroidered located between the two hoops. The present invention pertains to a device such as the device formed according to the examined and accepted application of Japanese Utility Patent No. Sho-62-3424.

A mounting device for individual embroidery hoops, which is to be fastened to the controlled hoop guide of an embroidering machine and consists of a rectangular hoop that can be connected to the hoop guide for the three-point tensioning of the individual embroidery hoops, is known from the examined and accepted application of the Japanese utility patent No. SHO 62-3424. According to this disclosure the front, transverse leg of the rectangular hoop is provided with a projection with a plastic foam pad as one point of the three-point tensioning. A pair of levers acting as a holder for a clamping part covered with plastic foam on the tensioned surface is arranged at each lateral leg of the rectangular hoop. The clamping parts form the other points of the three-point tensioning device. One lever each of the two pairs of levers is inserted with a pivot pin at the end opposite the clamping part into a hole in the side leg. The other lever of each pair of levers is hinged on the first lever between the pin and the clamping part. A setscrew screwed into a nut inside the side leg is passed through a hole in the other end of the first lever and through an elongated slot in the side leg of the rectangular hoop.

The device is intended for mounting individual embroidery hoops of various sizes. An individual embroidery hoop is mounted so that the individual hoop is placed against the plastic foam pad of the projection on the front, transverse leg of the rectangular hoop, the setscrew is loosened, and the two pairs of levers are moved while longitudinally displacing the setscrews in the elongated slots of the lateral legs with a defined pressure exerted on the circumference of the individual embroidery hoop, so that the individual embroidery hoop will be fixed at three points. The mounted position of the individual embroidery hoop is secured by tightening the setscrews.

The loosening, tightening, and displacement of the setscrews and the swiveling of the pairs of levers caused by the displacement each time the embroidery hoop is changed requires particular attention and is relatively complicated and time-consuming, because if the longitudinal displacement of the setscrews and consequently the swiveling of the pairs of levers are not completely uniform in this arrangement. The individual embroidery hoop will assume a different position relative to the central axis between two pairs of levers each time, so that the position of the initial stitch and consequently also the position of the embroidery pattern on the product being embroidered will also change each time, which is not acceptable for most applications. That is, the displacement each time the embroidery hoop is changed either impairs the quality of the products or requires correction of the mounting of the material to be embroidered or of the embroidery hoop, which is associated with loss of time. Moreover, because the holding force with which each embroidery hoop is mounted depends on how strongly the clamping parts are pressed by hand against the embroidery hoop by swiveling the pairs of levers with the clamping pieces during the displacement of the setscrews and it may therefore show great variations from one embroidery hoop to the next, the reliability and the accuracy of the mounting strongly depend on how carefully the operator performs his work.

SUMMARY AND OBJECTS OF THE INVENTION

It is an object of the present invention to design an embroidery hoop with a mounting device for individual embroidery hoops, which are to be detachably connected to the mounting device wherein the hoops consist of an inner hoop and an outer hoop surrounding the inner hoop with the fabric to be embroidered located between the hoops so that each individual embroidery hoop is always mounted with the same holding force and is always brought into the correct position for the start of the embroidery process.

According to the invention, a three-point mounting means is provided comprising two opposite holders, one of which has two contact surfaces, the surfaces enclosing an angle for providing fitted support surfaces of the outer hoop. The opposite other holder has a bow spring with a depression for a projection, the projection being arranged on the outer hoop on the bisector of the angle enclosed between the two contact surfaces.

The position of the embroidery hoop is exactly defined by the contact surfaces arranged at an angle relative to one another in the shape of a prism at a holder that can be connected to the hoop guide in the Y direction, and the position of the embroidery hoop in the X direction is exactly defined by the projection snapping into the depression at the bow spring, so that the embroidery process always begins at the same point. The use of a bow spring ensures that the holding force is not subject to variations, because it does not depend on how carefully the operator performs the mounting operation.

In an embroidering machine with a mounting device as specified above, which has a transversely slotted outer hoop, which has at least two opposite support surfaces for fitted contact surfaces of holders arranged opposite to each other, and whose separate ends are connected by a turnbuckle, the turnbuckle is usually arranged (e.g., West German Utility Patent No. 1,980,503) in a location rotated through a certain angle relative to the axis of symmetry of the opposite contact surfaces. When mounting fabrics to be embroidered of different thickness, the transversely slotted outer hoop is expanded to different extents. The support surfaces intended to come into contact with the contact surfaces of the holders are thus rotated through a certain angle relative to the contact surfaces of the holders. As a consequence of this, the two-part individual embroidery hoop will assume different angular positions relative to the axis of symmetry of the contact surfaces, depending on the thickness of the fabric to be embroidered, when inserted into the holders, as a result of which the position of the motif or embroidery pattern in the embroidered product deviates from the desired position, but this problem has been remedied so far only by remounting the fabric to be embroidered in the correct position or by mounting it in another embroidery hoop, which was associated with considerable losses of time and had to be repeated several times in most cases, because the amount of correction cannot be easily estimated during the mounting.

It is therefore of particular importance to arrange the turnbuckle so that it is arranged in the axis of symmetry of the contact surface opposite the two contact surfaces and therefore also arranged in the axis of symmetry of the two contact surfaces of the other holder in order to always achieve an angularly symmetrical expansion of the transversely slotted outer hoop relative to the axis of symmetry of the contact surfaces regardless of the thickness of the fabric to be embroidered during mounting and thus to reliably put the individual embroidery hoop into the holders in the correct position for the position of the embroidery pattern to be produced.

An advantageous embodiment of the mounting device with the turnbuckle arranged as described immediately above includes a holder opposite the contact surfaces 4 at the bow spring with two contact surfaces enclosing an angle for support surfaces on the outer hoop and the bow spring provided with a depression for a projection located on the outer hoop on the bisector of the angle enclosed between the contact surfaces.

Due to the design of the bow spring with an oblique stopping surface with a locking shoulder adjoining it for the projection of the outer hoop, an individual embroidery hoop can be placed into the mounting device practically "blindly".

Another possibility of facilitating the insertion and reliable fixation of an embroidery hoop is given by providing a depression formed by a hollow cone-shaped blind hole and the projection formed by a cup-shaped pin.

The height position of the individual embroidery hoops in the mounting device is exactly defined by the contact surfaces of one holder being provided on elevated ribs with the free ends of the support projections on the outer hoop fitted to the ribs in conjunction with the design discussed immediately above.

A design of one of the holders of the mounting device, which is advantageous from the viewpoint of production technology provides that the bow spring is made in one piece when formed with one of the holders.

Overextension of the bow spring is avoided by the provision of a limiting stop on the holder for the excursion of the bow spring.

The provision of the holders arranged on the side parts of an intermediate frame that can be connected to the drive of the embroidering machine and providing one holder such that it is adjustable in the wide direction and can be locked with the intermediate frame make it possible to connect the intermediate hoop to the hoop guide to insert an individual embroidery hoop of a different shape or size and to adjust only one of the holders on the intermediate hoop.

A design of the locking device which is advantageous from the viewpoint of production technology provides that two opposite leaf springs, which are made in one piece with the holder and have a stop bolt for holes of the intermediate frame, are used as the locking device.

By providing a spring pressure means in the slot of the outer loop, by which the hoop is pre-tensioned so that it is forced to part, the axis of symmetry of the contact surfaces of the outer hoop remains unchanged regardless of the thickness of the fabric to be embroidered, so that changes in the position of the fabric to be embroidered are avoided.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DESCRIPTION OF THE PREFERRED EMBODIMENTS

Figures 1, 2, 3:
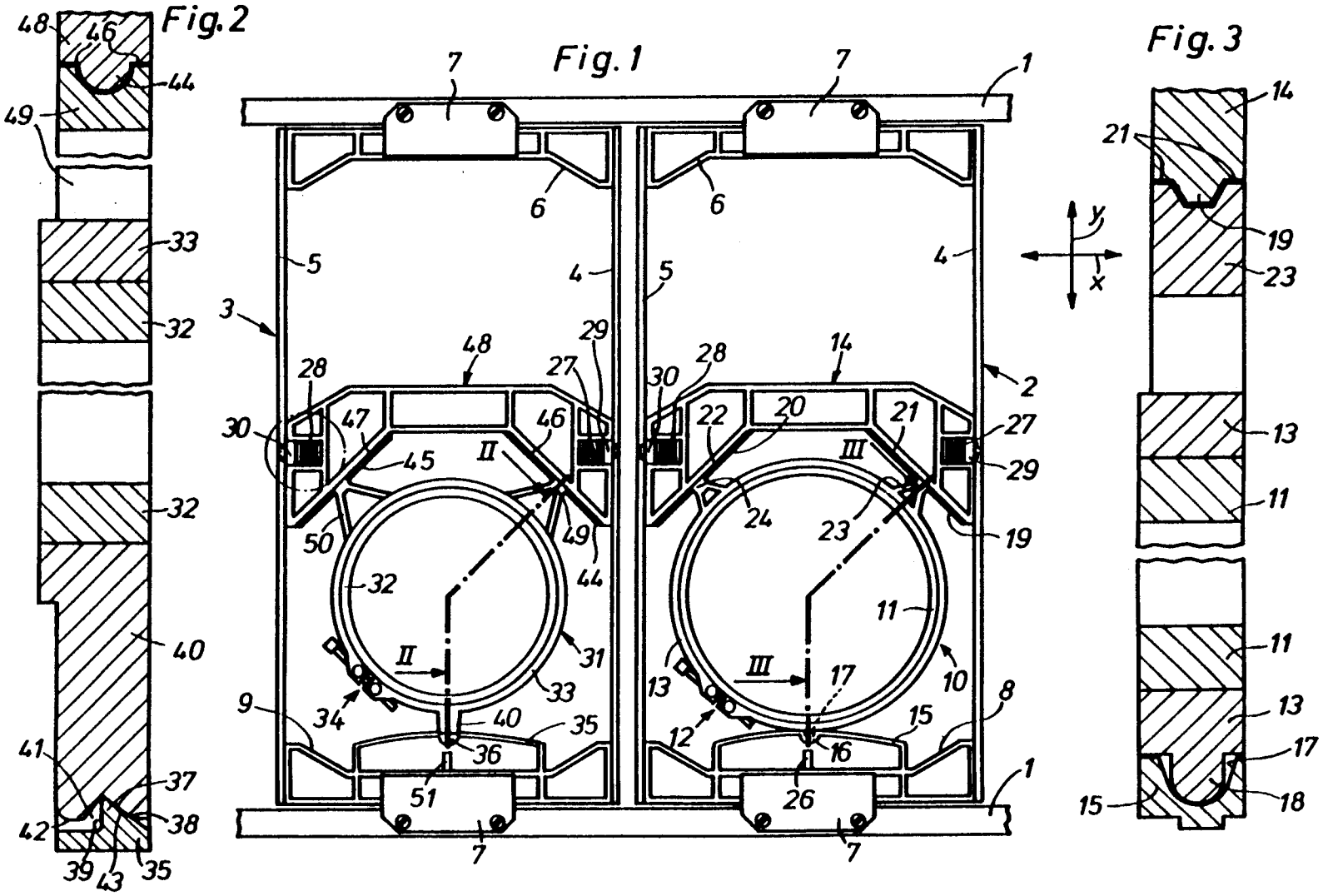
FIG. 1 is a top view of the mounting device fastened to the work carrier of an embroidering machine, with two individual embroidery hoops, which have fixing means of different designs.
FIG. 2 is a sectional view taken along line II-II in FIG. 1 on an enlarged scale.
FIG. 3 is a sectional view taken along line III-III in FIG. 1, also on an enlarged scale.
Figure 6:
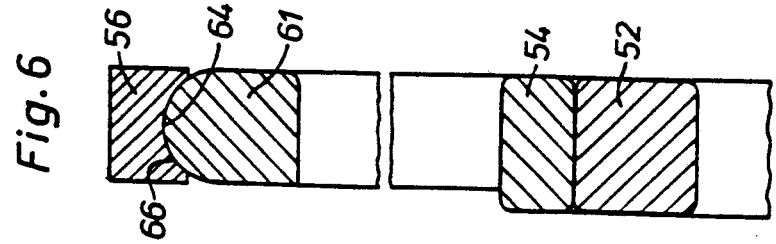
FIG. 6 is a sectional view taken along line VI-VI in FIG. 4 on an enlarged scale.

The long beams of the work carrier 80 of an embroidering machine, 81 (see FIG. 8) which can be moved relative to the embroidery heads 82 by, e.g., stepper motors 83, 84 in two directions that are at right angles to one another (X and Y directions) corresponding to the embroidery pattern to be produced, are designated by reference numeral 1.

Figure 8:
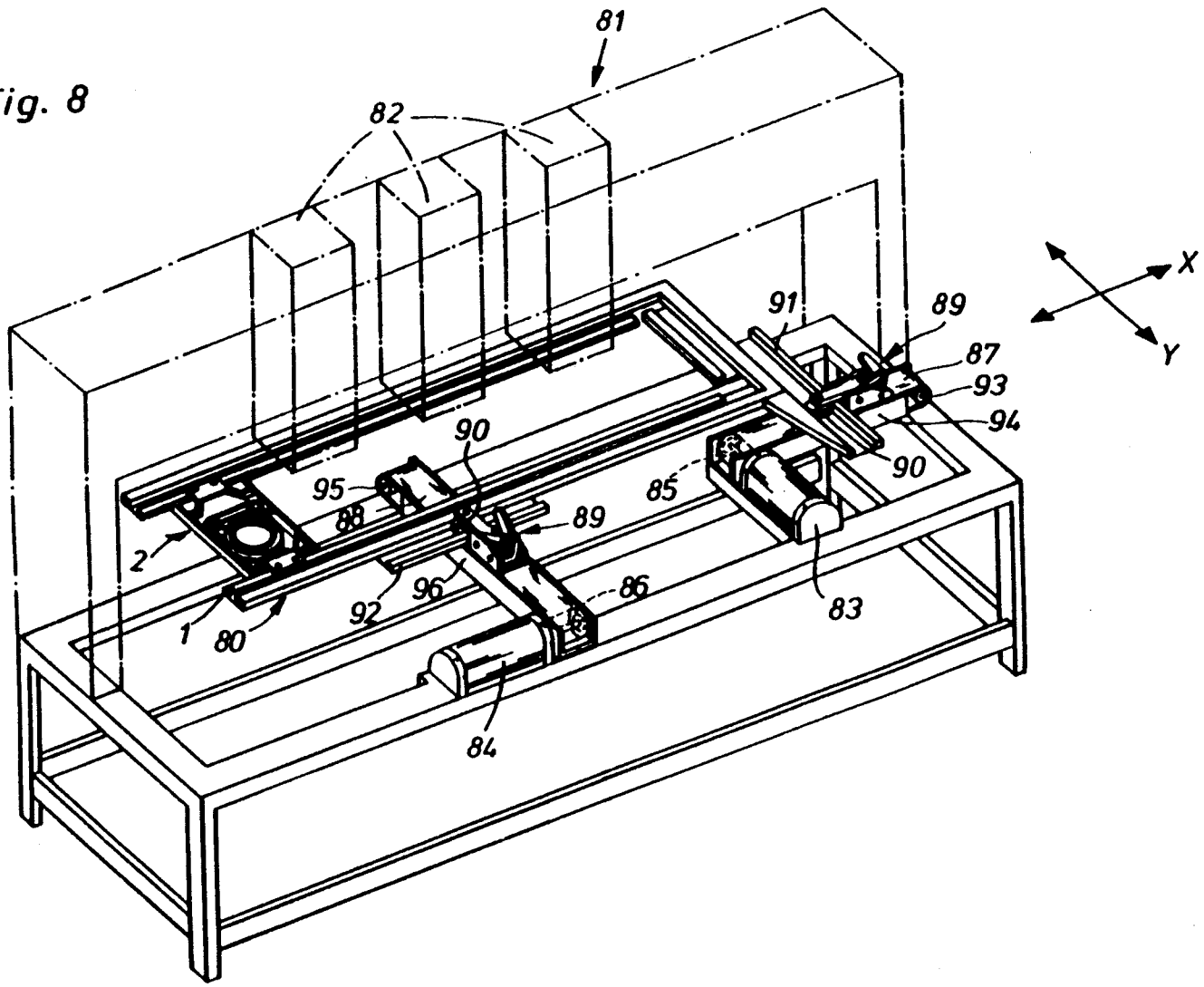
FIG. 8 is a simplified perspective view of a known multi-head embroidering machine with a work carrier, to which a holding frame, according to the invention, with an individual embroidery hoop is fastened.

As is known generally, for example from U.S. Pat. No. 4,444,133, the stepper motor 83 for the movement of the work carrier 80 in the "X" direction includes a gear 85, stepper motor 84 for the movement of the work carrier 81 in the "Y" direction includes a gear 86, these drive a gear belt 87 and 88 respectively. which carry clutch mechanisms generally designated 89. The clutch mechanisms 89 are engageable with the work carrier 80 for shifting it along the X and Y coordinates as indicated in FIGS. 1 and 8. Each clutch mechanism 89 includes a roller 90 as engagement means which engages a guide rail 91, 92 of the work carrier 80 respectively upon actuation of the clutch mechanism. The rotary movements of the stepper motor 83 in two directions are transmitted by the gear 85 to the endless gear belt 87 which is trained on the other end around a return gear 93 mounted on an auxiliary frame 94 fixed to the housing of the embroidering machine 81.

The rotary movements of the stepper motor 84 in the two directions are transmitted by the gear 86 to the endless gear belt 88 which is trained on the other end around the return gear 95 mounted on an auxiliary frame 96 fixed to the housing of the embroidering machine 81. A plurality of holding frames, e.g., 2 and 3, which serve to receive individual embroidery hoops of different shape and size, can be screwed onto the long beams 1. The holding frames 2 and 3 consist of two side parts 4 and 5 which are connected on the upper side, relative to FIG. 1, to a fastening bracket 7 by a cross strut 6 each. On the lower side, the side parts 4 and 5 of the holding frame 2 are connected by a holder 8 having a fastening bracket 7 and the side parts 4 and 5 of the holding frame 3 are connected by a holder 9, which also has a fastening bracket 7. The holding frames 2 and 3 with the brackets 7 are screwed onto the long beams 1.

To safely hold an individual embroidery hoop 10, which consists of a closed inner hoop 11 and a transversely slotted outer hoop 13 connected by a turnbuckle 12, a holder 14 that is arranged adjustably on the side parts 4 and 5 of the holding frame 2 and a bow spring 15 integrated within the said holder 8 are provided.

A hollow cone-shaped blind hole 17 for a cup-shaped pin 18 on the outer hoop 13 is located in a thickened part 16 of the bow spring 15. The pin 18 and the blind hole 17, into which it is inserted, form one of the points of the three-point tensioning device of said individual embroidery hoop 10. The two other points are located on two ribs 19 and 20 of trapezoidal cross section with contact surfaces 21 and 22 on the holder 14. In this embodiment, the support and contact surfaces 19 through 22 enclose a right angle. The blind hole 17 forms a contact surface for the pin 18 and is located on the bisector of this angle.

Two support projections 23 and 24, whose free ends are fitted to the ribs 19 and 20 and contact surfaces 21 and 22, are provided on the outer hoop 13. To limit the excursion of the bow spring 15 during the insertion and removal of the individual embroidery hoop 10, a stop 26 is provided on the holder 8.

The holder 14 can be tensioned in a plurality of positions by stop bolts 29 and 30 that are under the effect of compression springs 27 and 28 with the side parts 4 and 5 of the holding frame 2 in order to make it possible to mount individual embroidery hoops of different shape and sizes.

The holding frame 3 serves to receive another embroidery hoop, 31, which consists of a closed inner hoop 32 and a transversely slotted outer hoop 33 with a turnbuckle 34. A bow spring 35, which has a web 37 (FIG. 2) on a thickened part 36 with an oblique stopping face 38 and a locking shoulder 39 joining it, is integrated within the holder 9.

A projection 40 on the outer hoop 33 cooperates with the web 37 of the bow spring 35 having the stopping surface 38 and the locking shoulder 39. A V-shaped groove 41 with a rounded sliding surface 42 for the oblique stopping surface 38 of the web and with a surface 43 fitted to the oblique surface of the stopping surface 38 are provided in the free end of the projection 40.

The web 37 and the groove 41 form one of the points of the three-point mounting mechanism of the individual embroidery hoop 31. The two other points are located on two ribs 44, 45 of semicircular cross section and contact surfaces 46 and 47 of a holder 48. The ribs 44 and 45 and the contact surfaces 46 and 47 enclose a right angle. Said projection 40 for said web of said bow spring 35 is located on the bisector of this angle.

Two support projections 49 and 50, whose free ends are adjusted to the shape of the ribs 44 and 45 and the contact surfaces 46 and 47, are provided on the outer hoop 33.

To limit the excursion of the bow spring 35 during the insertion and removal of the individual embroidery hoop 31, a stop 51 is provided on the holder 9. The holder 48 can also be tensioned in a plurality of positions by means of said stop bolts 29 and 30, which are under the effect of said compression springs 27 and 28, with the side parts 4 and 5 in order to make it possible to mount individual embroidery hoops of different shapes and sizes.

FIGS. 4 through 7 show an individual embroidery hoop 55 consisting of a closed inner hoop 52 and an outer hoop 54 separated by a transverse slot 53 with a holder 56 and a bow spring 57, which is integrated in the holder 8 or 9, as the bow spring 15 or 35, as well as a turnbuckle 58 and an embodiment of a locking device 59 for the holder 56, which is advantageous from the viewpoint of production technology.

Figure 5:
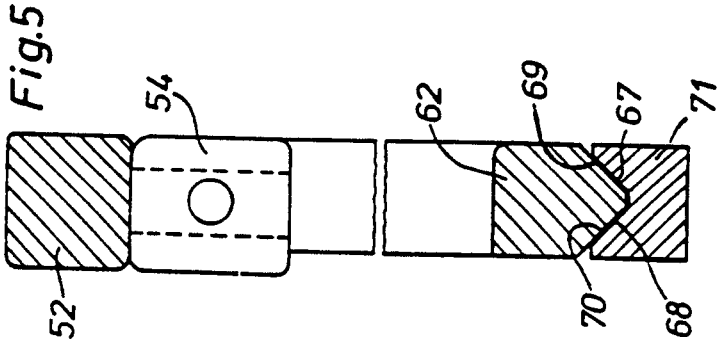
FIG. 5 is a sectional view taken along line V-V in FIG. 4 on an enlarged scale.
Figure 7:
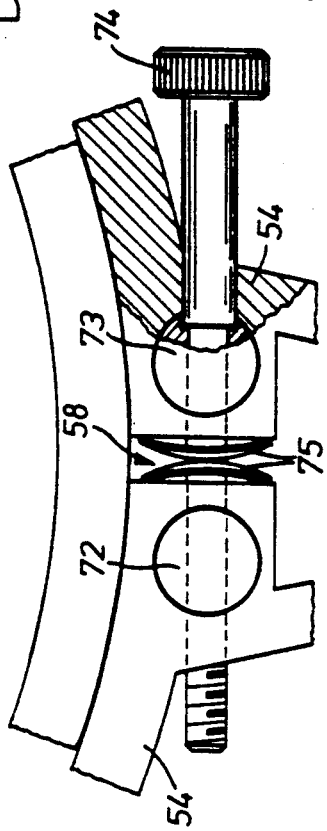
FIG. 7 is a turnbuckle for the outer hoop with spring pressure means in its transverse slot.
Figure 4:
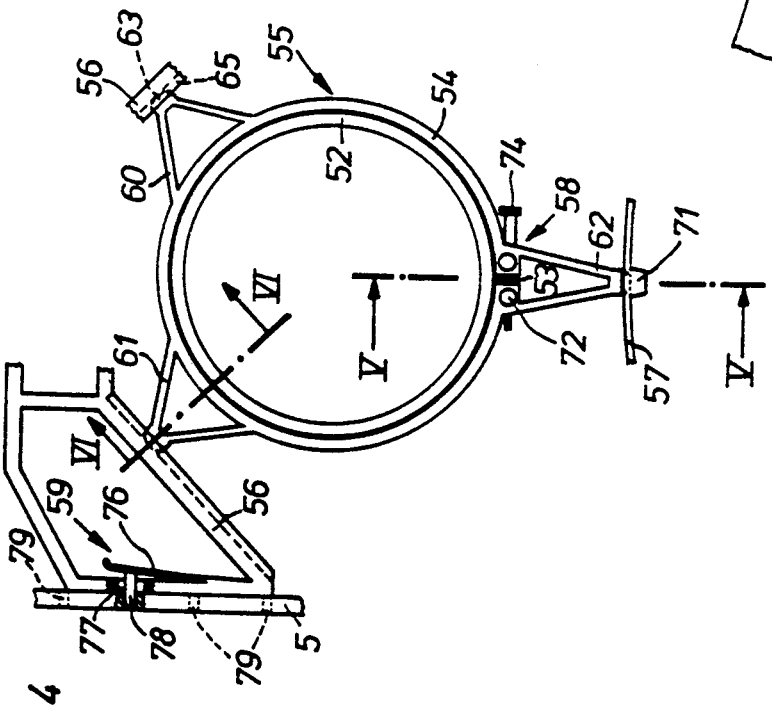
FIG. 4 is a plan view of an individual embroidery hoop with a turnbuckle arranged in the axis of symmetry of the outer hoop and part of a holder with a locking device of another design.

Three support projections 60, 61, 62 are provided on the outer hoop 54. The free ends of the support projections 60 and 61 are rounded and form support surfaces 63 and 64 for contact surfaces 65 and 66 of a corresponding concave shape (FIG. 6) on the holder 56, which is otherwise designed similarly to the holder 14 or 48. The contact surfaces 65 and 66 enclose an angle (with its center along an axis of symmetry corresponding to line V—V). The support projection 62 is located on the bisector of this angle. The free end of the support projection 62 is wedge-shaped (FIG. 5). The wedge surfaces 67 and 68 form support surfaces for contact surfaces 69 and 70 of an appropriate shape on a thickened part 71 of the bow spring 57. The stops 26 and 51 on the holder 8 and 9, respectively, which are shown in FIG. 1, serve to limit the excursion of the bow spring 57.

The turnbuckle 58, which is arranged in the axis of symmetry of the support surfaces 63 and 64 and contact surfaces 65, 66, 69, and 70, consists of a cylindrical nut 72 provided with a transversely extending threaded hole. The nut 72 is inserted freely rotatably into a hole provided in the outer hoop 54 near the transverse slot 53. A cylindrical step bearing is provided with a transversely extending stepped hole and is inserted freely rotatably into a hole on the other side of said transverse slot 53 in said outer hoop 54. A tightening screw 74 designed as a collar screw, is passed through a hole passing through the slotted ends of the outer hoop 54 and the stepped hole in the step bearing 73 and is screwed into the nut 72. Two cup springs 75 arranged on the tightening screw 74 are provided in the transverse slot 53. The transversely slotted outer hoop 54 is pre-tensioned by said cup springs 75, which seek to force the hoop apart.

Instead of the two support projections 60 and 61, it is also possible to provide only one support projection opposite the support projection 62 with a support surface for a contact surface to be provided on the holder 56.

Each of the locking devices 59 (FIG. 7) arranged on two opposite sides of the holder 56 consists of a leaf spring 76 made in one piece with the holder 56 with a stop bolt 78 passed through a longitudinal slot 77 in the holder 56, which the stop bolt 78 engages with one of a plurality of holes 79 provided in the side parts 4 and 5 of the holding frame 2 and 3, respectively in order to lock the holder 56 in a plurality of positions with said holding frame 2 and 3, respectively. This makes it possible to insert individual embroidery hoops of different shapes and sizes into said holding frame 2 and 3.

Mode of operation

During the embroidering operation, the fabric to be embroidered is placed on the outer hoop 13 or 33 outside the embroidering machine with the turnbuckle 12 or 34 opened, pressed into the outer hoop 13 or 33 with the inner hoop 11 or 32, and tensioned with the turnbuckle 12 or 34 between the inner hoop and the outer hoop.

To remove the individual embroidery hoops 10 and 31 at the end of an embroidery process, the hoops are pulled against the bow spring 15 or 35, so that the bow spring 15 or 35 will bend and come into contact with the stop 26 or 51. The support projections 23 and 24 now separate from the ribs 19 and 20 and the contact surfaces 21 and 22 and the support surfaces 49 and 50 separate from the ribs 44 and 45 and the contact surfaces 46 and 47. The individual embroidery hoops 10 and 31 can subsequently be easily tilted upward with the rear part and removed from the holding frame 2 and 3.

The embroidery hoop 10 with the fabric to be embroidered mounted in it in advance is inserted so that the support projections 23 and 24 are brought into contact with the ribs 19 and 20 and the contact surfaces 21 and 22 of the holder 14. The pin 18 now lies on the released bow spring 15, so that the individual embroidery hoop 10 can be aligned. By gently pressing the embroidery hoop 10 in the area of the pin 18, the bow spring 15 is bent via pin 18 to the stop 26, and the pin 18 snaps into the blind hole 17.

The free ends of said support projections 49 and 50 of the embroidery frame 31 with the fabric to be embroidered mounted in it in advance are brought into contact with the ribs 44 and 45 and the contact surfaces 46 and 47 of the holder 48 in the same way. The projection 40 of the outer hoop 33 now lies on the released bow spring 35, so that the individual embroidery hoop 31 can be aligned. By gently pressing the area of the projection 40, the bow spring 35 is bent to the stop 51 via the sliding surface 42 cooperating with the oblique stopping surface 38 and the web 37 snaps into the groove 41.

Both the height position of the embroidery hoop 10 or 31 and the position relative to the frame guide of the embroidering machine are determined accurately and reproducibly by the ribs 19 and 20 as well as 44 and 45 and the contact surfaces 21 and 22 as well as 46 and 47 in conjunction with the free ends of the support projections 23 and 24 as well as 49 and 50, which free ends are adjusted thereto, and the pin 18 in conjunction with the blind hole 17 and the web 37 in conjunction with the groove 41.

The peculiarity or uniqueness of the mode of operation of the individual embroidery hoop 55 is the fact that during the opening of said turnbuckle 58, said outer hoop 54 is opened symmetrically by said cup springs 75 because of the arrangement of said transverse slot 53 in the axis of symmetry of said support surfaces 63/64, 67/68 and said contact surfaces 65/66 and 69/70 for adjustment to the thickness of the fabric to be embroidered, so that the angular position of said support projections 60 and 61 remains unchanged regardless of the thickness of the fabric to be embroidered. As a consequence of this, the individual embroidery hoop 55 is always inserted in the same angular position into the holders 56 and 8 or 9. Consequently, corrections to be performed by remounting the fabric to be embroidered are avoided altogether.

As in the case of the individual embroidery hoops 10 and 31, in the individual embroidery hoop 55 the fabric to be embroidered is also placed on the outer hoop 54 outside the embroidering machine with the turnbuckle 58 opened corresponding to the position of the pattern to be embroidered, during the embroidery process, pressed into the outer hoop 54 with the inner hoop 52, and tensioned with the turnbuckle 58 between the inner hoop and the outer hoop. Insertion into the holders 56 and 8 or 9 and removal of the individual embroidery hoop 55 are performed in the same way as described above based on the example of the individual embroidery hoops 10 and 31.

While specific embodiments of the invention have been shown and described in detail to illustrate the application of the principles of the invention, it will be understood that the invention may be embodied otherwise without departing from such principles.

What is claimed is:

1. An embroidering machine with a mounting unit for individual embroidery hoops, the embroidery hoops being detachably connected to the mounting unit and consisting of an inner hoop with an outer hoop surrounding said inner hoop and fabric to be embroidered located between said inner hoop and said outer hoop, comprising: three-point mounting means for the fixation of an outer embroidery hoop, comprising two opposite holders including a first holder with two contact surfaces, said two contact surfaces enclosing an angle, said two contact surfaces receiving fitted support surfaces of said outer hoop, a second holder having a bow spring with a depression for receiving a projection arranged on the outer hoop at a location bisecting the angle enclosed between the two contact surfaces of the first holder.

2. An embroidering machine according to claim 1, wherein the bow spring includes an oblique stopping surface with a locking shoulder adjoining said stopping surface for the projection of the outer hoop.

3. An embroidering machine according to claim 1, wherein the depression is formed by a hollow cone-shaped blind hole and the projection is formed by a cup-shaped pan.

4. An embroidering machine according to claim 1, wherein the contact surfaces of the first holder are provided on elevated ribs, support projections are provided on the outer hoop with free ends which are fitted to the ribs.

5. An embroidering machine according to claim 1, wherein the contact surfaces of one holder are concave, the support surfaces on the outer hoop having free ends fitted to the contact surfaces.

6. An embroidering machine according to claim 1, wherein the bow spring is made in one piece with one of the holders.

7. An embroidering machine according to claim 1, wherein the second holder includes a limiting stop for limiting the movement of the bow spring.

8. An embroidering machine according to claim 1, wherein each of the holders are connected to side parts of an intermediate frame, said intermediate frame being connected to the drive of an embroidering machine.

9. An embroidering machine according to claim 8, wherein said first holder is adjustable in the (y) direction and can be locked with the intermediate frame.

10. An embroidering machine according to claim 9, wherein two opposite leaf springs are formed in one piece of one of said holders and includes a stop bolt connectable with a hole provided in the intermediate frame for use as a locking device.

11. An embroidering machine according to claim 9, wherein a spring pressure means is provided in a slot formed in the outer hoop, said spring pressure means for pre-tensioning said outer hoop such that is forced apart.

12. An embroidering machine with a mounting device for individual embroidery hoops, the embroidery hoops being detachably connected to a mounting device and including an inner hoop and a transversely slotted outer hoop surrounding the inner hoop with fabric to be embroidered located between the inner hoop and the outer hoop, comprising:

at least two opposite support surfaces provided on the outer hoop; first and second holders arranged in mutually opposite locations, each of the holders having fitted contact surfaces for engaging and supporting the support surface of the outer hoop; a turnbuckle connecting ends of said slotted outer hoop; one of said holders having a contact surface provided engaging a bow spring, said turnbuckle being along an axis of symmetry of said contact surface which engages the bow spring and opposite contact surfaces of an opposite holder.

13. An embroidering machine according to claim 12, wherein the other holder contact surfaces include first and second surfaces enclosing an angle and engaging support surfaces provided on the outer hoop, said bow spring being provided with a depression for a projection located on the outer hoop at a location bisecting the angle enclosed between said first and second contact surfaces.

14. An embroidering machine according to claim 12, wherein the bow spring has an oblique stopping surface with a locking shoulder adjoining it for the protection of the outer hoop.

15. An embroidering machine according to claim 12, wherein the bow spring includes a depression formed by a hollow cone-shaped blind hole, a projection being formed by a cup-shaped pan provided on the outer hoop for engaging said blind hole.

16. An embroidering machine according to claim 12, wherein the contact surfaces of the one holder are provided on elevated ribs and the free ends of the support projections on the outer hoop are fitted to said ribs.

17. An embroidering machine according to claim 12, wherein the contact surfaces of one holder are concave and free ends of the support surfaces on the outer hoop are fitted to the contact surfaces.

18. An embroidering machine according to claim 12, wherein said bow spring is made in one piece with one of the holders.

19. An embroidering machine according to claim 12, wherein a limiting stop is provided connected to one of the holders for limiting the excursion of the bow spring.

20. An embroidering machine according to claim 12, wherein the holders are arranged on side parts of an intermediate frame, said intermediate frame being connected to the drive of an embroidering machine.

21. An embroidering machine according to claim 12, wherein the one holder is adjustable in the (y) direction and can be locked with respect to the intermediate frame.

22. An embroidering machine according to claim 21, wherein two opposite leaf springs are provided formed in one piece with one of the holders, a stop bolt being provided for engaging a hole provided in the intermediate frame to lock the holder with respect to the intermediate frame.

23. An embroidering machine according to claim 12, wherein spring pressure means is provided in the slot of the outer hoop, said spring pressure means pre-tensioning said outer loop to force ends of said outer loop apart.

* * * * *